US006290425B1

(12) United States Patent
Cathiard et al.

(10) Patent No.: US 6,290,425 B1
(45) Date of Patent: Sep. 18, 2001

(54) DETACHABLE CLAMP WITH A LEAF SPRING

(75) Inventors: Jean Pierre Cathiard, Noyarey; Bernard Roux, Sassenage; Daniel Michel, Saint Egrēve; Jean Souchal, Grenoble, all of (FR)

(73) Assignee: Pomagalski S.A. (FR)

( * ) Notice: Subject to any disclaimer, the term of this patent is extended or adjusted under 35 U.S.C. 154(b) by 0 days.

(21) Appl. No.: 09/308,595

(22) PCT Filed: Nov. 20, 1996

(86) PCT No.: PCT/FR96/01837

§ 371 Date: May 21, 1999

§ 102(e) Date: May 21, 1999

(87) PCT Pub. No.: WO97/18980

PCT Pub. Date: May 29, 1997

(30) Foreign Application Priority Data

| | | |
|---|---|---|
| Nov. 22, 1995 | (FR) | 95 14267 |
| May 6, 1996 | (FR) | 96 05927 |
| May 6, 1996 | (FR) | 96 05928 |
| May 6, 1996 | (FR) | 96 05929 |

(51) Int. Cl.[7] ..... B61B 12/12; F16B 2/10

(52) U.S. Cl. ..... 403/329; 104/209; 104/216; 403/330; 403/325

(58) Field of Search ..... 403/329, 330, 403/321, 322.1, 325, 326, 327; 104/173.1, 165, 174, 209

(56) References Cited

U.S. PATENT DOCUMENTS

| | | | | |
|---|---|---|---|---|
| 611,570 | * | 9/1898 | Dusedau | 104/206 |
| 645,314 | * | 3/1900 | Dusedau | 104/206 |
| 711,451 | * | 10/1902 | Davis | 104/206 |
| 4,653,406 | * | 3/1987 | Levi | 104/206 |
| 4,658,733 | * | 4/1987 | Kunczynski | 104/209 |
| 4,961,742 | * | 10/1990 | Torre | 81/319 X |
| 5,111,751 | * | 5/1992 | Zlotek | 104/206 |
| 5,568,771 | * | 10/1996 | Brochand | 104/206 |
| 5,829,327 | * | 11/1998 | Stanton | 81/111 |

FOREIGN PATENT DOCUMENTS

| | | | |
|---|---|---|---|
| 1080580 | * | 11/1955 | (DE) . |
| 1 080 589 | | 4/1960 | (DE) . |
| WO 87/01081 | | 2/1987 | (WO) . |

* cited by examiner

*Primary Examiner*—Lynne H. Browne
*Assistant Examiner*—Ernesto Garcia
(74) *Attorney, Agent, or Firm*—Parkhurst & Wendel, L.L.P.

(57) ABSTRACT

The disengageable clamp of a cable car or chair lift has a control lever 17 carrying the movable jaw 14, articulated on the fixed jaw 13. At least one flexion leaf spring 23 is interposed between the clamp body 10 and the control lever 17 in order to force this lever into the clamp closure position. Two leaf springs can be disposed on each side of the clamp body 10.

11 Claims, 10 Drawing Sheets

DETACHABLE CLAMP WITH A LEAF SPRING

The invention relates to a disengageable clamp for coupling a load to a track/traction cable for an overhead cable transportation installation, comprising a clamp body extending transversely on one side of the body, in a position coupled to the latter, and carrying an articulation of a suspension member supporting the load, a cable clamping vice, consisting of a fixed jaw carried by the clamp body and a movable jaw articulated on the fixed jaw, a control lever, which is integral with the movable jaw and extends the latter whilst lying and travelling in a plane perpendicular to the cable and containing the clamp body, in order to control the opening and closing of the vice, and at least one spring acting on the control lever in the closed position of the jaw.

BACKGROUND OF THE INVENTION

1. Discussion of Prior Art

A known clamp of the type mentioned (EP-A-0 056 919) has coil springs interposed between the clamp body and the control lever. The coil springs require an axial guide rod and articulations in the spring anchoring areas. This arrangement is complicated and the springs have a large amount of travel and are therefore bulky.

The aim of the present invention is to permit the production of a disengageable clamp with a simple and compact structure, insensitive to frost and ice, so as to be able to remain on line permanently.

The clamp according to the invention is characterised in that the spring is a flexion leaf spring, which cooperates on the one hand with the control lever and on the other hand with the clamp body, the leaf spring extending substantially in the said plane or parallel to this plane and in the general direction of the clamp body, and supplying the force for coupling the clamp to the cable.

A leaf spring can be housed in a restricted space and there is no risk of it being blocked by ice, the latter breaking under the least flexion of the spring. The absence of a guide rod also reduces the risk of blocking. The leaf of the spring can have, at rest, various shapes and, through a judicious choice of the anchoring points and/or of the configuration and structure of the leaf, it is easy to obtain a suitable curve for the variation in the clamp control force. The spring can be of a well known type with several leaves placed one on top of the other, with different characteristics.

The document WO-A-87 01081 and the document DE-B-10 80 580 disclose clamps incorporating a leaf spring, but this spring does not supply the force for coupling to the cable, which is derived from the weight of the car.

2. General Discussion of the Invention

According to a development of the invention, two springs are disposed symmetrically on each side of the plane containing the clamp body and control lever, so as to ensure the security of coupling of the clamp to the cable in the event of breakage of one of the springs and so as to distribute the forces.

According to one embodiment of the invention, the spring leaf, of elongate shape, is interposed between the clamp body and the control lever, one of the ends being, for example, anchored rigidly to the clamp body, on the same side as the vice, and the other end cooperating with a roller carried by the control lever, on the same side as the free end of the latter. The leaf thus extends almost parallel to the control lever and releases the space around the clamp body in the suspension member articulation area.

According to a variant embodiment, the leaf spring is almost straight, in the position of clamping the clamp, and is fixed at both ends, so as to be subjected to a buckling force during the opening movement of the clamp. The opening control is exerted on the control lever, in the usual fashion, or preferably directly on the spring.

According to another embodiment, the leaf spring has an appreciable curvature, for example in the form of a half loop or several loops in a drum shape, with a view to increasing the length of the leaf whilst limiting the bulk.

The ends of the spring leaf can be anchored rigidly, for example by embedding, on the clamp body and/or on the control lever, or can have an articulation allowing a limited relative movement.

According to another embodiment of the invention, the leaf spring is buttressed by its ends on the clamp body and its middle part cooperates with the control lever, a reverse arrangement being possible. One of the ends of the spring is, for example, embedded on the clamp body, whilst the opposite end is mounted for limited sliding by means of a rocker bar articulated on the clamp body. The two supports can consist of articulated rocker bars. The middle part of the spring is in abutment on a lug carried by the control lever in order to transmit the force of the spring to this lever. Two buttress springs with opposite curvatures can be associated by connecting their respective ends, the middle part of one of the springs cooperating with the control lever and that of the other spring with the clamp body. The ends of the springs are perfectly connected by articulations and, in this case, at least one of the middle parts is rigidly anchored to the clamp body and/or control lever.

Other advantages and characteristics will emerge more clearly from the following description of various embodiments of the invention given by way of examples and depicted in the accompanying drawings, in which:

DESCRIPTION OF THE DRAWINGS

FIGS. 5 and 6, 7 and 8, 10 and 11 are views similar to FIGS. 1 and 2, illustrating three variant embodiments according to the invention;

FIGS. 16 and 17, 18 and 19 are views similar to FIGS. 1 and 2, showing two embodiments of the invention, using buttressed springs.

DETAILED DESCRIPTION OF THE INVENTION

Figure 1:
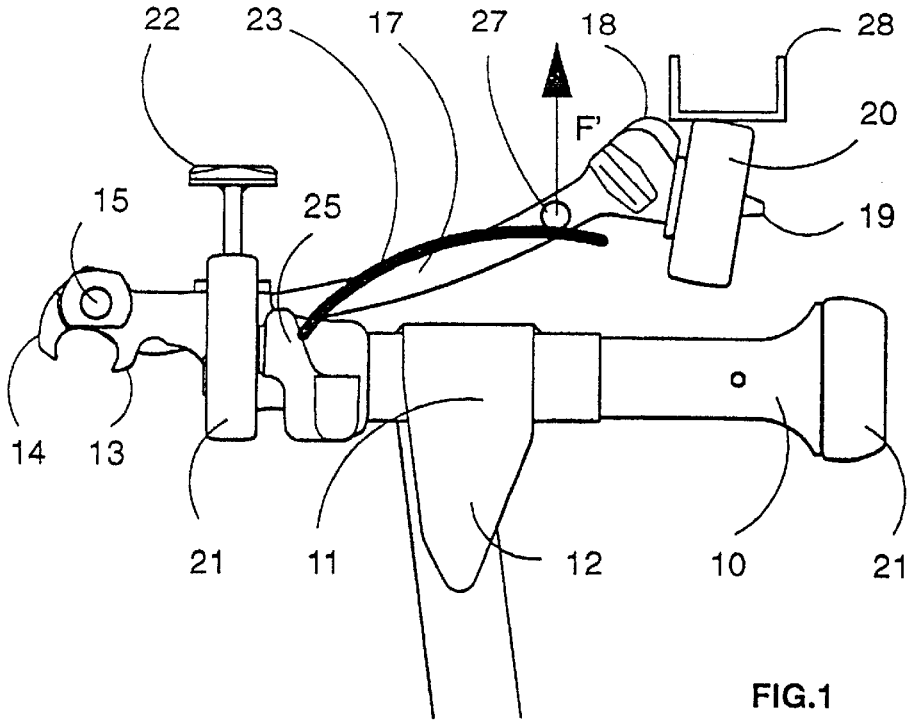
FIGS. 1 and 2 are schematic elevation views of a clamp according to the invention, depicted respectively in the open position and in the closed position.

In all the figures the same reference numbers are used to designate similar or identical parts. A disengageable clamp has an elongate body 10 which extends, in the position where the clamp is coupled to the cable, transversely to the cable. The body 10 carries an articulation 11 for a suspension member 12 and is extended by a pair of jaws 13, 14 forming a cable clamping vice. One 13 of the jaws is fixed and the other one 14, which is movable, is articulated on a shaft 15 carried by the body 10. In the position of clamping of the cable by the jaws 13, 14, the shaft 15 extends parallel above the cable. The movable jaw 14 is formed at the end 16 of a control lever 17, which extends and can travel, when pivoting on the shaft 15, in a plane perpendicular to the cable, which contains the clamp body 10 and which corresponds to the plane of FIG. 1. At the end 18, opposite the movable jaw 14, of the lever 17 there is fixed a rotation shaft 19 for a control wheel 20, able to cooperate with a control rail 28. The clamp body 10 carries bearing rollers 21 and a cross member 22 for driving by friction, in order to move the clamp, disengaged from the cable, in the stations on transfer rails. Such a clamp is well known and it is unnecessary to describe it in any further detail.

Figure 2:
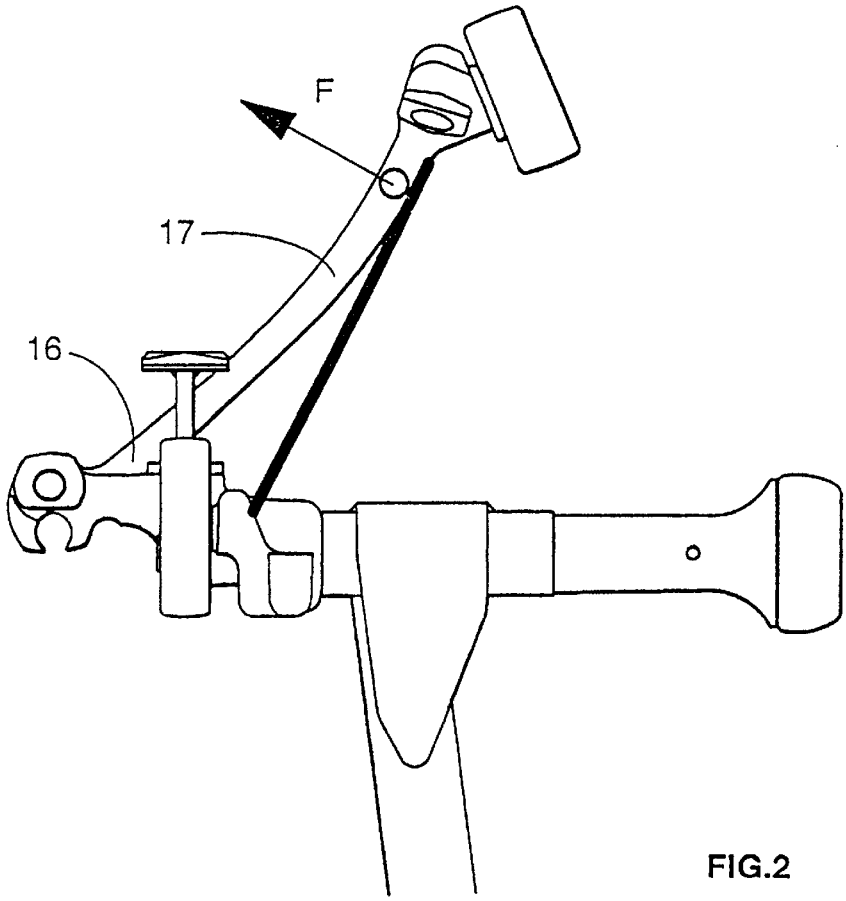
Figure 9:
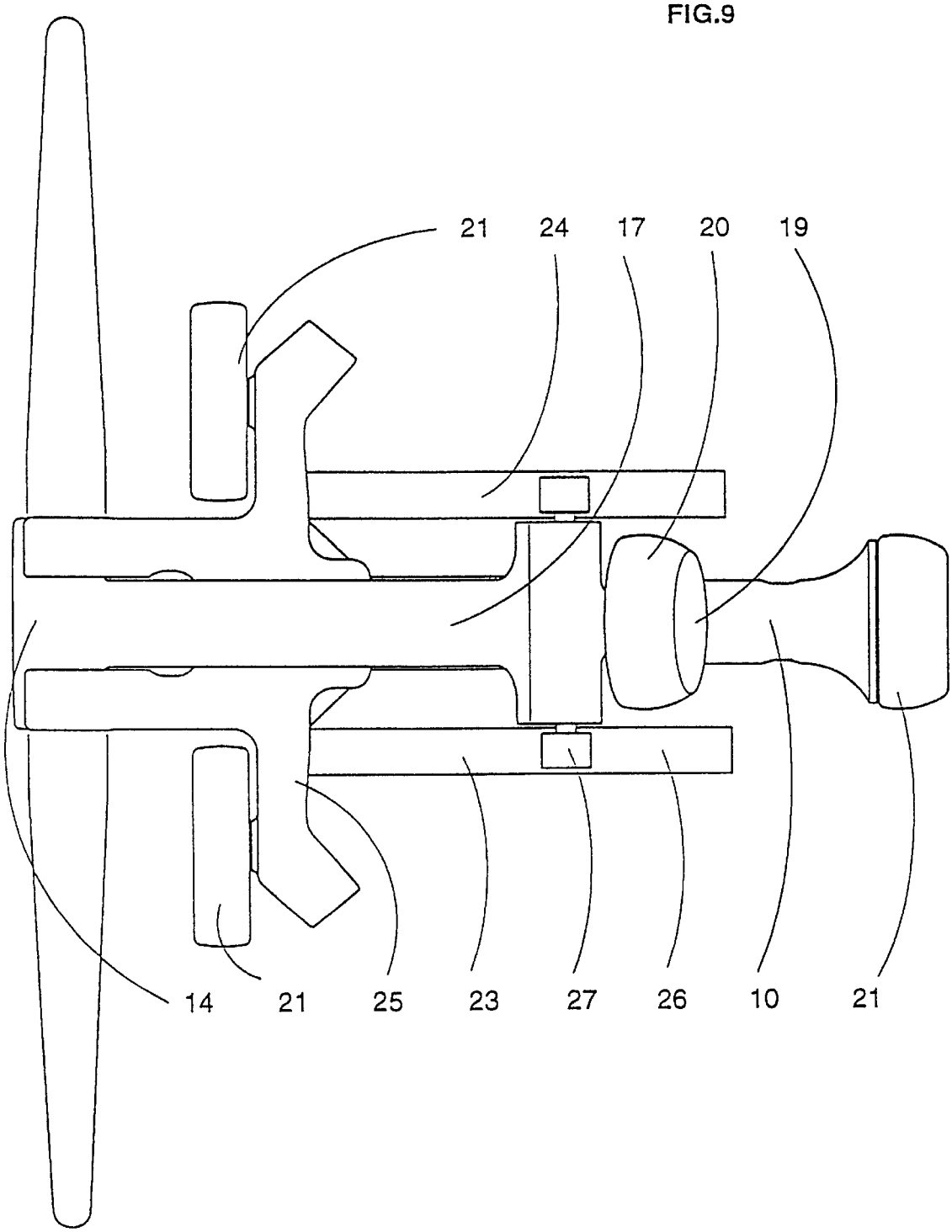
FIG. 9 is a plan view of the clamp according to FIG. 1.
Figure 1:
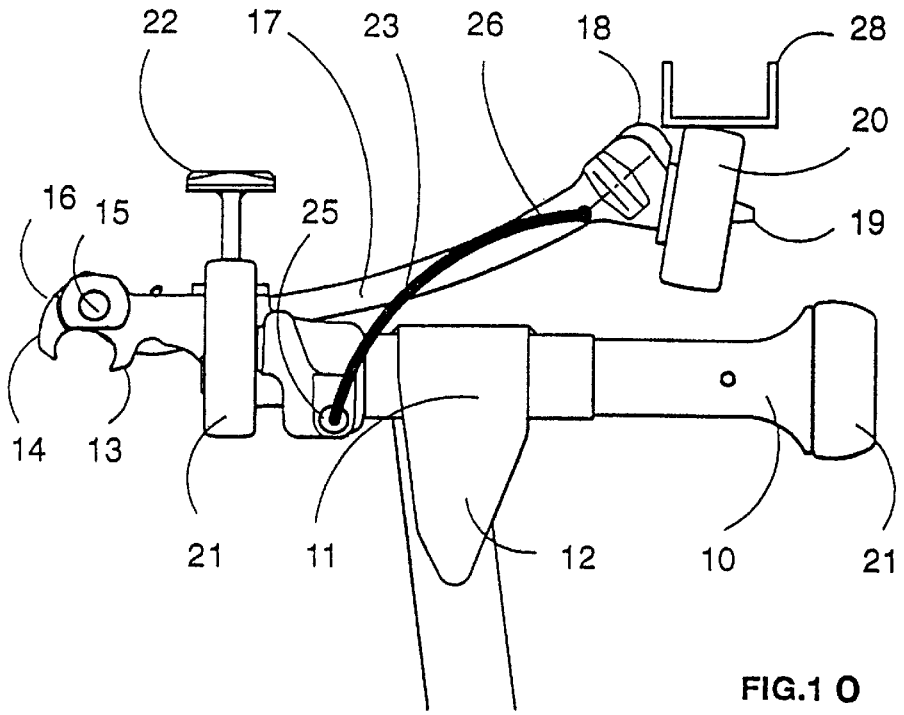

Referring particularly to FIGS. 1, 2 and 9, it can be seen that the control lever 17 is acted on in the cable clamping position by a pair of leaf springs 23, 24 interposed between the control lever 17 and the clamp body 10. The two springs 23, 24 are disposed symmetrically on each side of the plane defined by the control lever 17 and the clamp body 10 and extend parallel to this plane in the general direction of the control lever 17. One 25 of the ends of the springs 23, 24 is rigidly anchored by embedding in the clamp body 10 on the same side as the jaws 13, 14 whilst the opposite end 26 bears on a roller 27, mounted for rotation on the controller lever 17 on the same side as the control wheel 20. In the closed position of the clamp, depicted in FIG. 2, the leaf springs 23, 24 are substantially straight, under pretension, and exert a force F on the control lever 17, tending to pivot the latter in the counter clockwise direction, for clamping the cable. When the control rail 28 moves the control wheel 20 downwards, the control lever 17 pivots in a clockwise direction towards the position, depicted in FIG. 1, of opening of the clamp, counter to the force F' exerted by the springs 23, 24, curved downwards. It should be noted that this arrangement of the springs 23, 24 completely releases the space around the articulation 11 of the suspension member 12. The roller 27 can consist of a single stop or conversely have a guide runner for the end 26 of the spring. It is clear that the roller 27 can be disposed on the clamp body 10, the spring 23, 24 then being embedded on the control lever 17, and that the clamp can have a single spring or conversely a larger number of springs.

Figure 3:
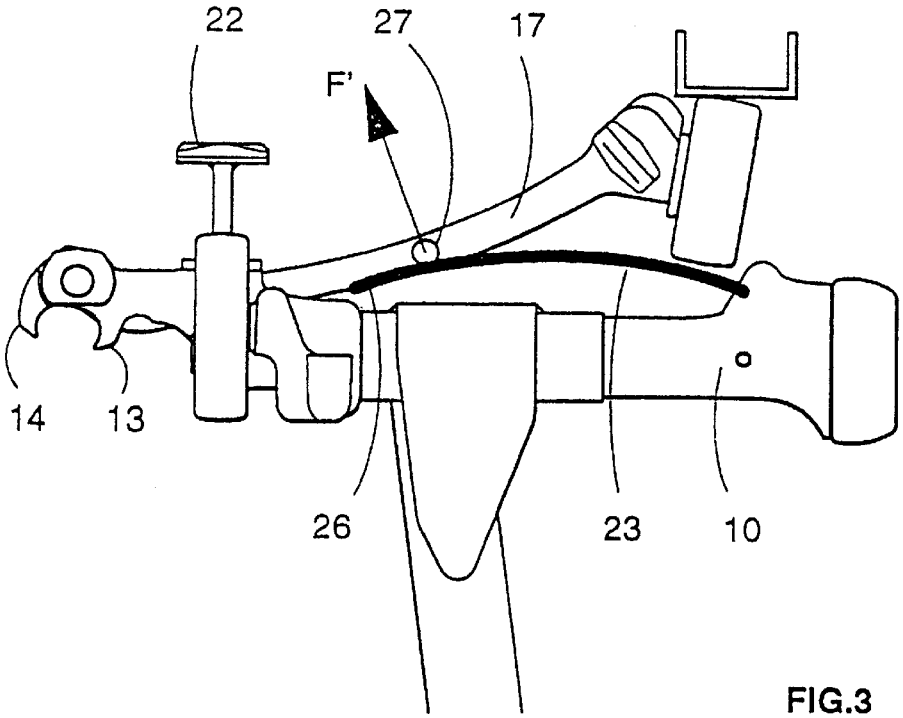
FIGS. 3 and 4 are views similar to FIG. 1 showing two different arrangements of the springs.

FIG. 3 illustrates a variant in which the springs 23, 24 are embedded on the side of the clamp body 10 opposite to the jaws 13, 14, while their free end 26 is in abutment on a roller 27 disposed on the middle part of the control lever 17. The functioning of the clamp is not changed, but it should be noted, that, in the arrangement of the springs 23, 24 according to FIGS. 1 and 2, the lever arm of the forces F and F' remains substantially constant, while in the arrangement according to FIG. 3 the lever arm varies appreciably.

Figure 4:
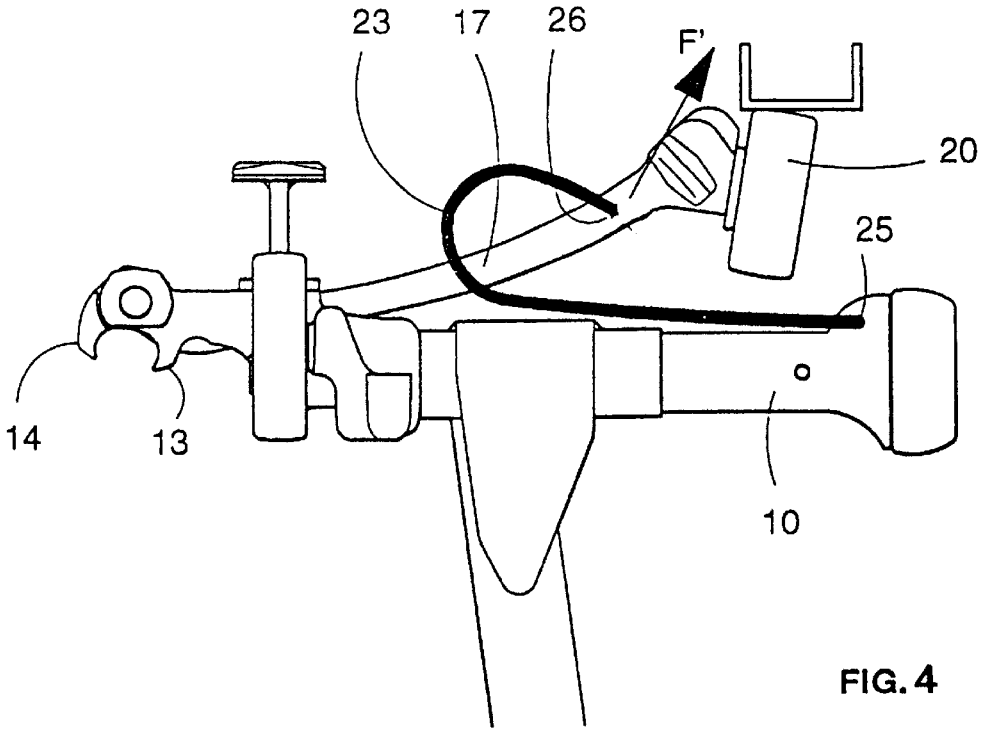

In the embodiment depicted in FIG. 4, the springs 23, 24 are bent in the form of a half-loop, one end of which 25 is embedded on the clamp body 10, on the side opposite the jaws 13, 14, and the other end 26 of which is embedded on the control lever 17 on the same side as the wheel 20. The great length and the bent shape of the spring leaf 23, 24 allow compensation for the relative movement of the anchoring points, and the leaf can be embedded at both ends, which simplifies the assembly.

Figure 5:
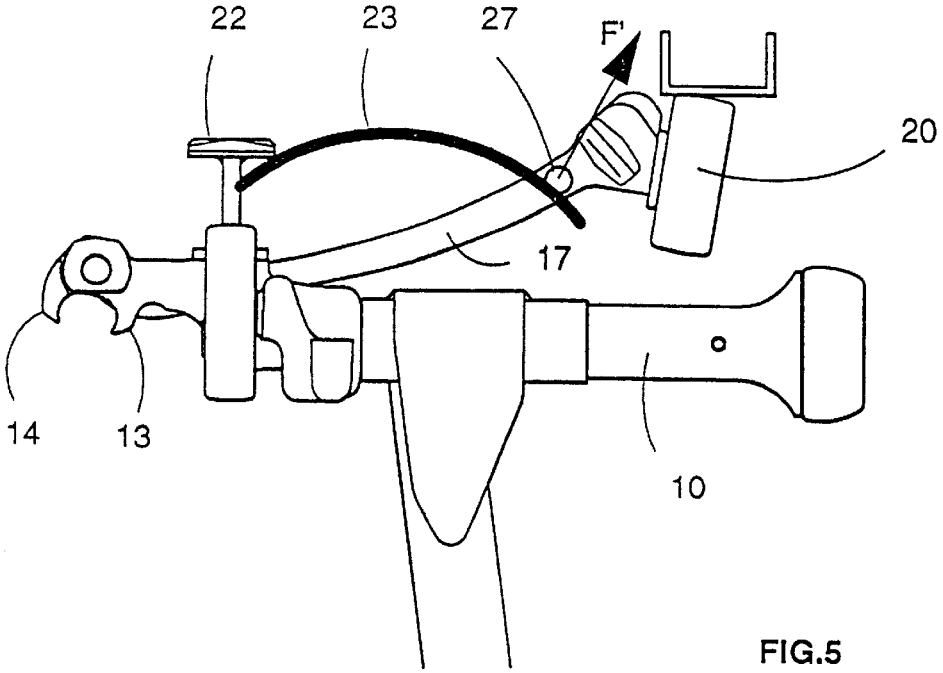
Figure 6:
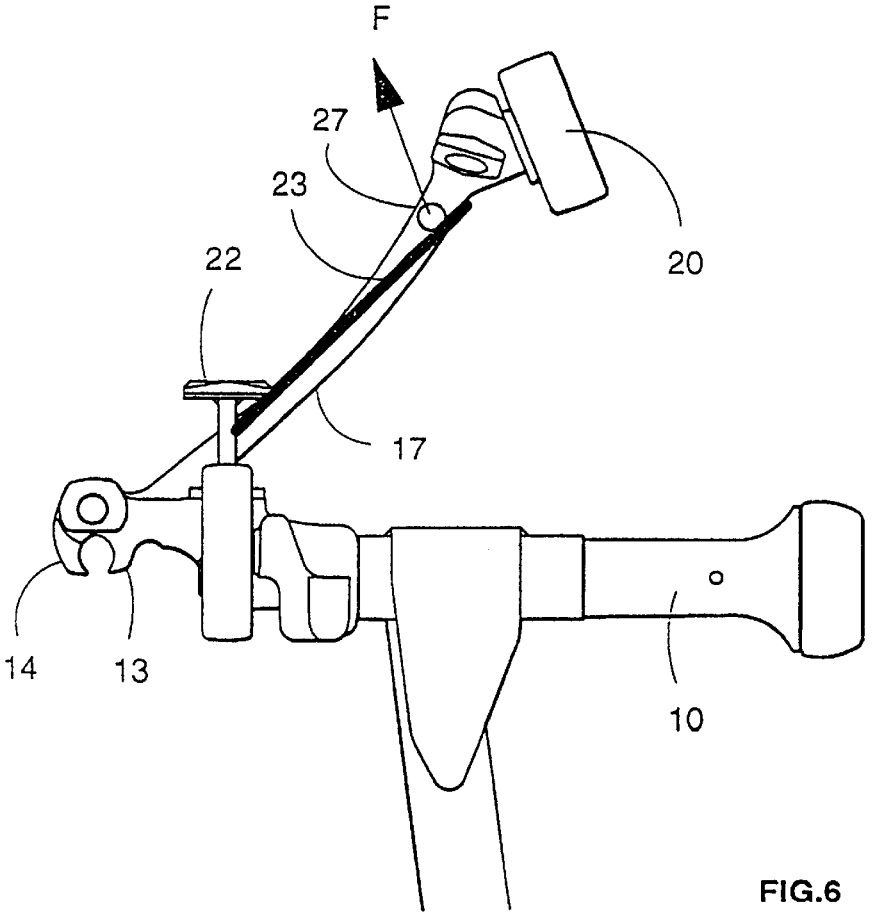

The embodiment illustrated by FIGS. 5 and 6 repeats the arrangement according to FIGS. 1 and 2, with the abutment of the spring 23, 24 on rollers 27 on the same side as the roller 20 of the control lever 17 and embedding on the clamp body 10 on the same side as the jaws 13, 14, but the embedding point is shifted upwards level with the cross member 22. In this case, the lever arm of the force F' of the open clamp is lower than that of the force F of the closed clamp and the control force for the clamp can thus be maintained substantially constant or even reduced as the clamp opens. It will be understood that a judicious choice of the characteristics of the springs 23, 24 and of the anchoring points makes it possible to obtain the required curve for the variation in clamp control force.

Figure 7:
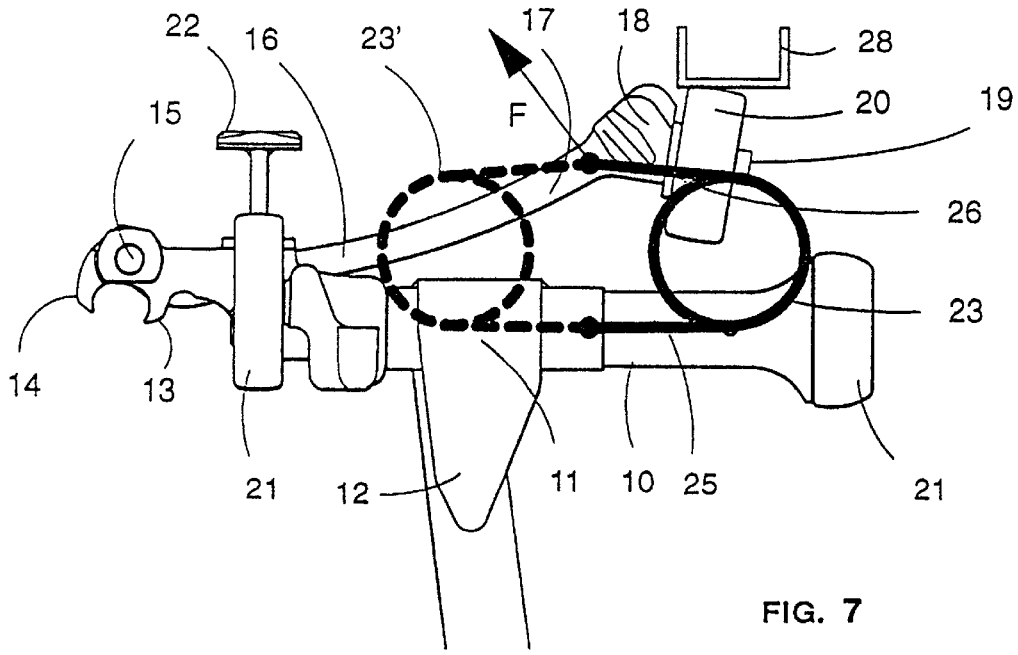
Figure 8:
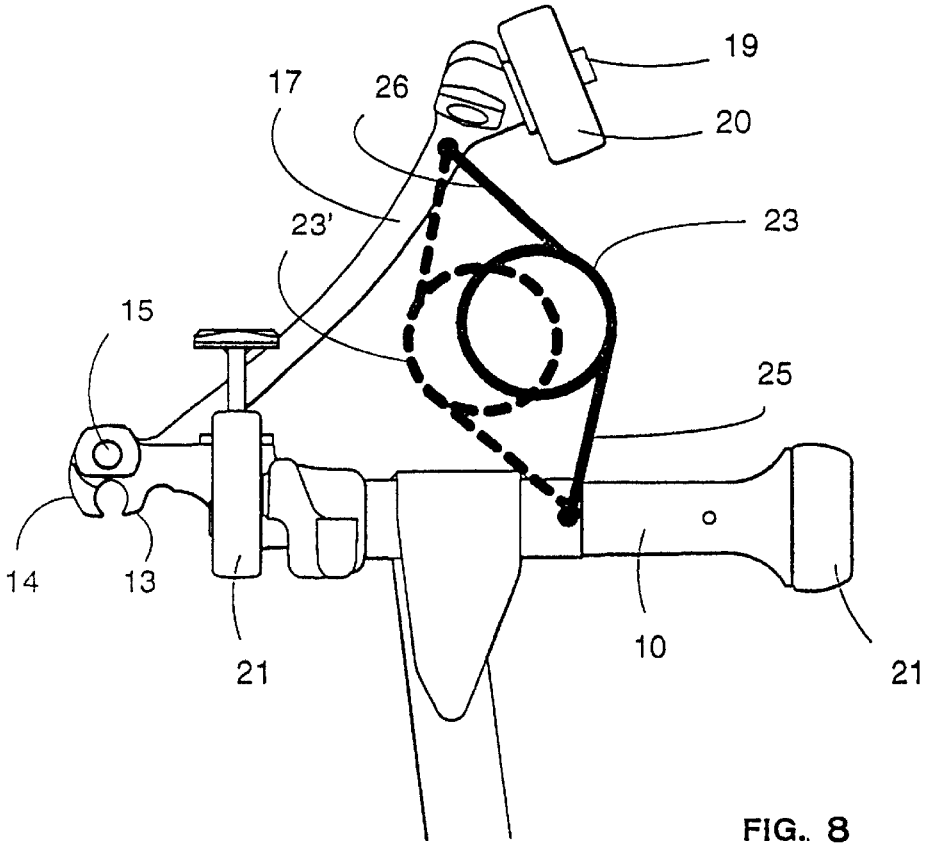

Referring to FIGS. 7 and 8, it can be seen that the springs 23, 24 are coiled in a drum shape, in the form of a clothes peg spring, one 25 of the ends of the springs 23, 24 being articulated on the clamp body 10, whilst the opposite end 26 is articulated on the control lever 17 on the same side as the control wheel 20. In the closed position of the clamp, depicted in FIG. 8, the springs 23, 24 are under pre-tension and exert a force on the control lever 17, tending to pivot the latter in the counter clockwise direction, for clamping of the cable. It should be noted that one or both ends 25, 26 can be embedded. With each spring 23, 24 there can be associated a conjugate spring 23', depicted in broken lines in FIGS. 7 and 8. The conjugate spring 23' has the same shape and is articulated at the same points as the associated spring, but is arranged opposite and its direction of coiling is the contrary. In this way the restoring force and the security of the clamp are increased.

Figure 11:
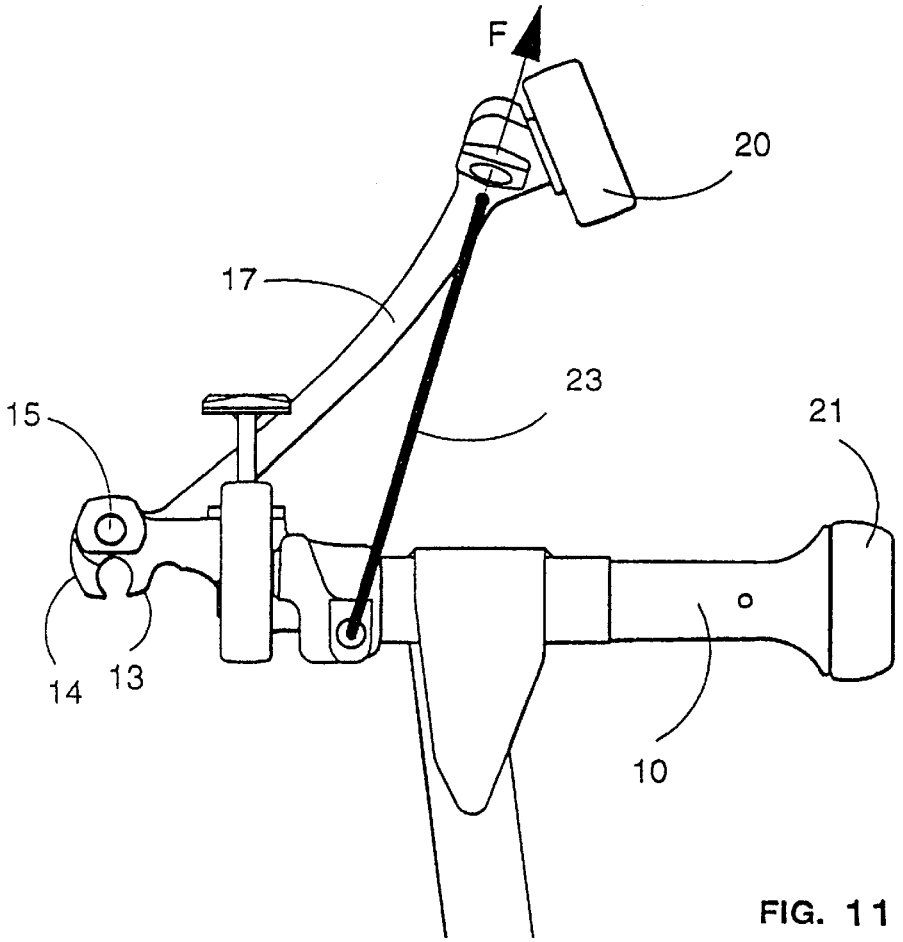
Figure 12:
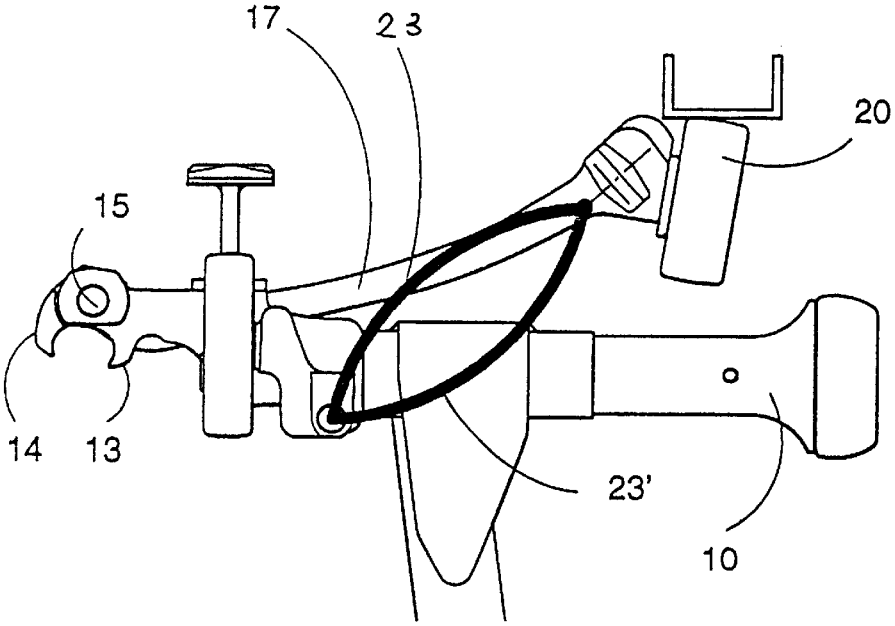
FIG. 12, similar to FIG. 10, shows a spring consisting of two combined leaves.

In FIGS. 10 and 11, the springs 23, 24, of elongate shape, are substantially straight, under pre-tension and slightly precurved, in the position of closure of the clamp, depicted in FIG. 11. They exert a force F on the control lever 17, tending to pivot the latter in the counter clockwise direction, for clamping the cable. When the control rail 28 moves the control wheel 20 downwards, the control lever 7 pivots in the clockwise direction towards the position, depicted in FIG. 10, of opening of the clamp, causing the springs 23, 24 to flex by buckling. The force opposed by the springs 23, 24 remains substantially constant from the very start of the buckling, which makes it possible to limit the control energy. The articulation of the ends 25, 26 of the springs 23, 24 consist, for example, of a simple bending of these ends in a loop around a pivot carried by the control lever 17 or clamp body 10. One or both ends 25, 26 of the springs 23, 24 can be embedded. The springs 23, 24 can be precurved on one side or the other, and it is advantageous to associate, with each spring 23, 24, a conjugate spring 23', of opposite curvature, and articulated at the same points, in order to constitute pairs of springs, 23, 23' in the form of an ellipse, as depicted in FIG. 12, in order to double the force and increase security.

Figure 13:
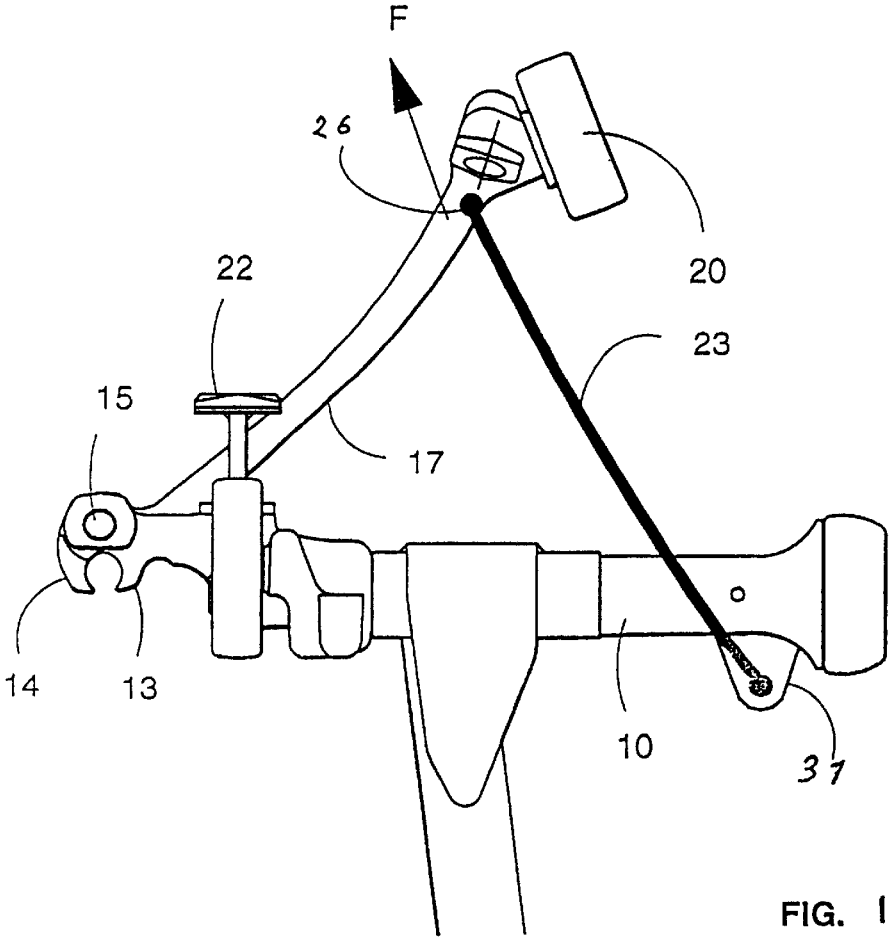
FIG. 13 is a view similar to that of FIG. 11, showing a different arrangement of the spring.

According to the variant illustrated by FIG. 13, the springs 23, 24 are articulated in the vicinity of the ends of the lever 17 and clamp body 10, the point of fixing to the clamp body 10 advantageously being shifted downwards by means of an appendage 31, so as to elongate the springs 23, 24 and to adapt their characteristics.

Figure 14:
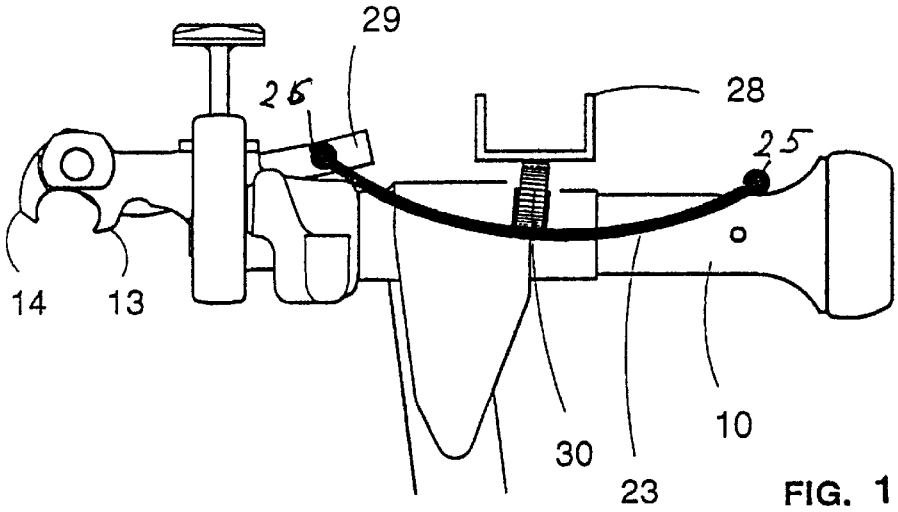
FIGS. 14 and 15 are views similar to FIGS. 1 and 2, illustrating a method of controlling the clamp by direct action on the spring.
Figure 15:
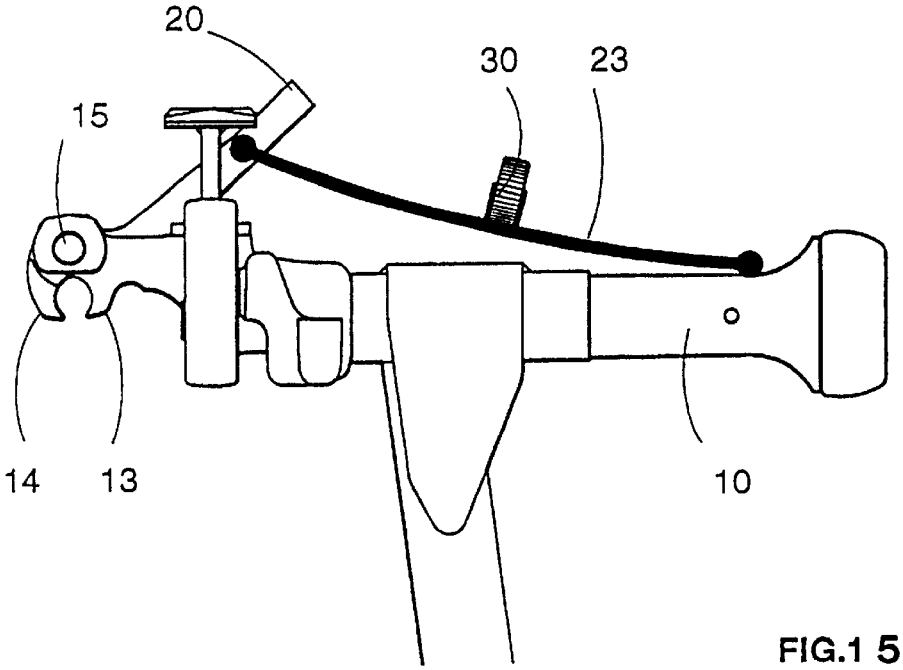

FIGS. 14 and 15 illustrate another method of controlling the clamp. The movable jaw 14 of the clamp is carried by a shortened lever 29, on which one 25 of the ends of the spring 23, 24 is articulated, the other end 26 is articulated on the shortened lever 29 on the opposite side to the jaws 13, 14. In its middle part the spring 23, 24 carries a loose wheel 30, able to cooperate with the control rail 28, extending along the path of movement of the clamp, in order to cause the spring 23, 24 to buckle and the jaws 13, 14 to open. The buckling force on the spring 23, 24 can obviously be applied to the spring 23, 24 in any other operative manner, notably by means of shoes. Such a clamp is particularly simple and it is clear that the spring 23, 24 can be disposed differently, notably according to one of the variants described above.

The method by which the flexion leaf springs 23, 24 work is different in the embodiments depicted in FIGS. 16 to 19. In the clamp according to FIGS. 18, 19, one 25 of the ends of the springs 23, 24 is anchored rigidly by embedding in the clamp body 10 on the same side as the jaws 13 and 14, whilst the opposite end 26 is articulated on a rocker bar 34, the opposite end of which is articulated on the clamp body 10. The middle part of the springs 23, 24 is loaded by a roller 27 carried by the control lever 17. In the closed position of the clamp, depicted in FIG. 19, the leaf springs 23, 24 are curved under pre-tension and exert a force on the control lever 17, tending to pivot the latter in the counter clockwise direction, for clamping the cable. When the control rail 28 moves the control wheel 20 downwards, the control lever 17 pivots in a clockwise direction towards the position, depicted in FIG. 18, of opening of the clamp, counter to the force F exerted by the springs 23, 24. It is clear that the roller 27 can be disposed on the clamp body 10, the springs 23, 24 then being fixed, in abutment through their two ends, to the control lever 17 with an opposite curvature.

Figure 16:
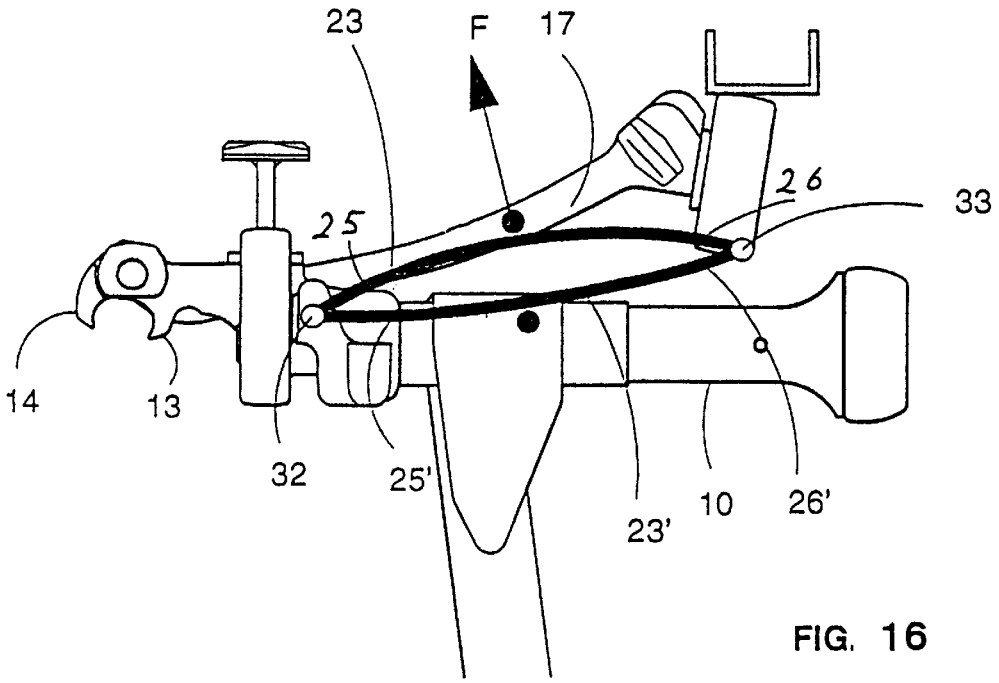
Figure 17:
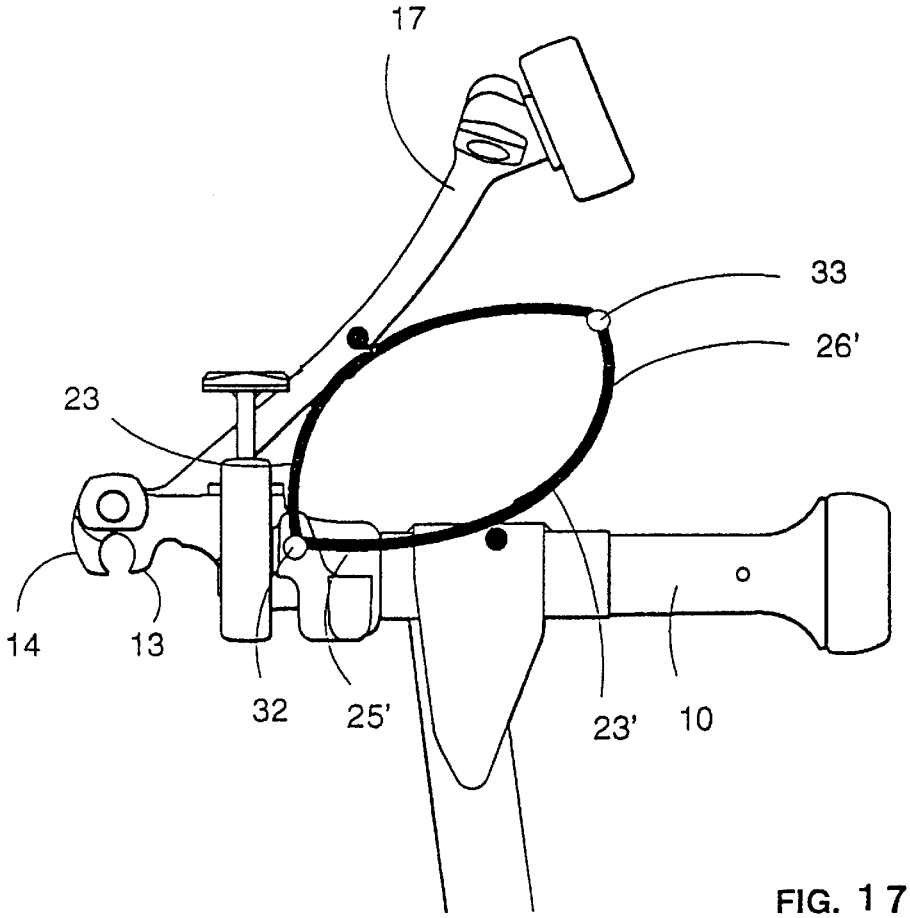
Figure 1:
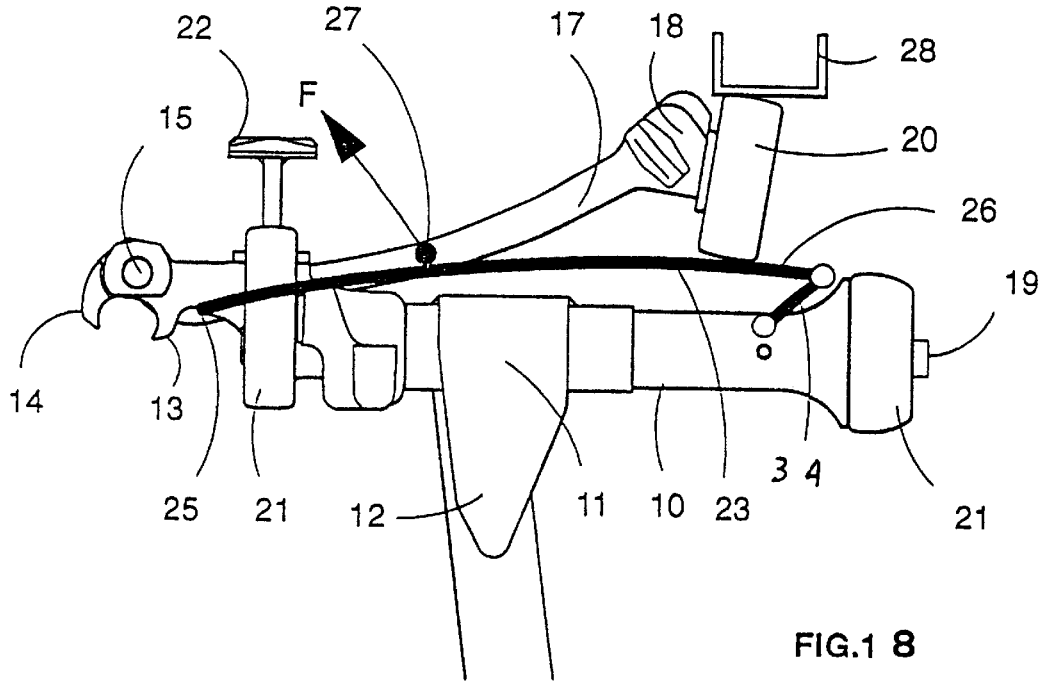
Figure 1:
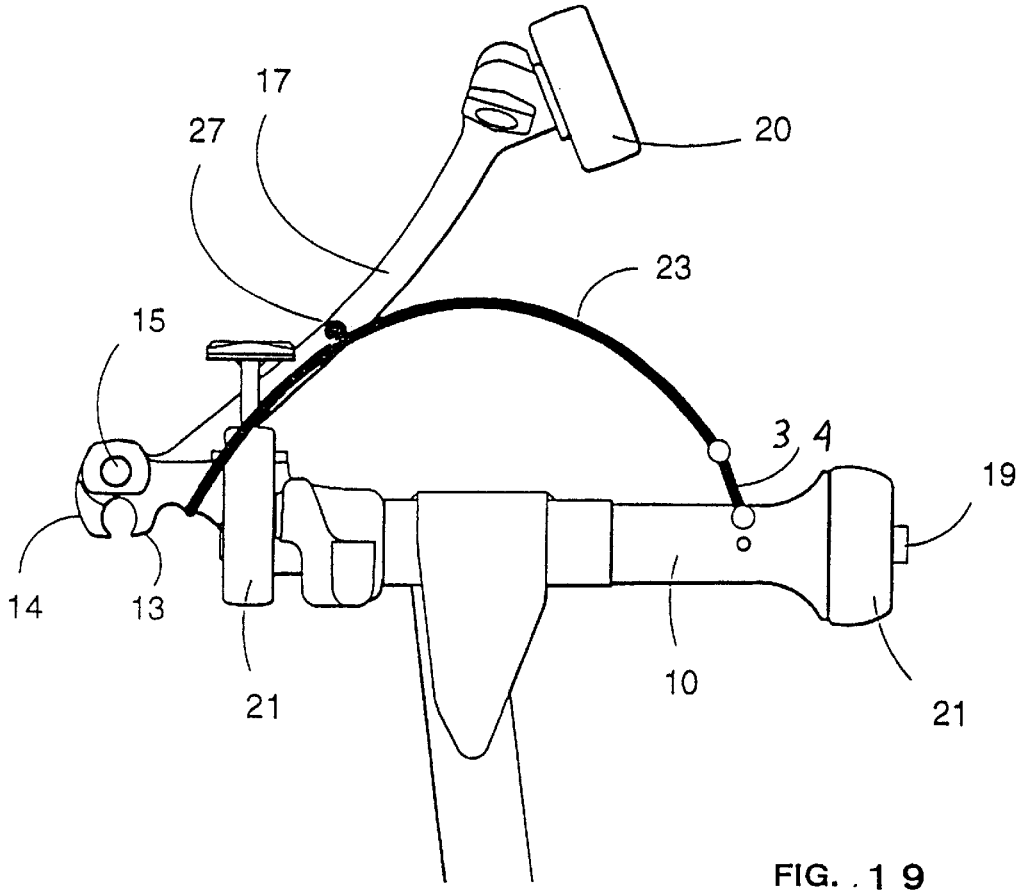

FIGS. 16 and 17 illustrate a variant, in which each spring 23, 24 is associated with a conjugate spring 23' with an opposite curvature, each end 25, 26 and the spring 23, 24 being connected by an articulation 32, 33 to a conjugate end 25', 26' of the associated spring 23', in order to constitute a pair of springs of elliptical shape. The middle part of the spring 23, 24 cooperates with the control lever 17, while the middle part of the conjugate spring 23' cooperates with the clamp body 10. These middle parts can be fixed rigidly, for example by embedding, or be articulated on the clamp body 10 and/or control unit 17. They can also be in abutment on a roller carried by the control lever 17 and/or clamp body 10, in a manner similar to that described above, the positioning of the conjugate springs 23, 23' being in this case provided by any effective means, for example by mounting the articulation 32 for rotation on a shaft carried by the clamp body 10, as depicted in FIGS. 16 and 17.

Arrangements, notably for fixing the springs, described in detail in one of the above examples are of course applicable to the other examples.

What is claimed is:

1. A disengageable clamp for coupling a load to a track/traction cable for an overhead cable transportation installation, said clamp consisting essentially of:

a clamp body having a transverse extension coupled on one side of the body, and carrying an articulation of a suspension member for supporting the load, a cable clamping vice consisting of a fixed jaw carried by the clamp body and a movable jaw articulated on the fixed jaw, a control lever integral with the movable jaw and extends from the movable jaw for lying and moving in a plane, in order to control opening and closing of the vice, and at least one spring exerting a force on the control lever in the closed position of the jaw, wherein said spring is a flexion leaf spring in contact with the control lever and with the clamp body, said leaf spring extending substantially parallel to said plane, and being capable of supplying a force for coupling the clamp to the cable.

2. The clamp of claim 1, wherein one of the ends of the leaf spring is rigidly anchored to the clamp body, and the other end is in contact with the control lever, allowing a limited relative movement.

3. The clamp of claim 1, wherein one of the ends of the leaf spring is rigidly anchored to the control lever, and the other end is in contact with the clamp body, allowing a limited relative movement.

4. The clamp of claim 1, wherein the leaf spring is in the form of a half-loop, one of the ends which is anchored on the clamp body on the side opposite the jaws, and the other end of which is anchored to the control lever on a side on which is located a control wheel.

5. The clamp of claim 1, wherein the leaf spring is in the form of a clothes-peg spring, having a part coiled in a drum shape, the turns of which lie in planes parallel to said plane.

6. The clamp of claim 1, wherein the leaf spring is fixed to the clamp body and to the control lever in order to be loaded at an end thereof, while being in an almost straight position on closing of the jaws and in a buckled position on opening of the jaws.

7. A disengageable clamp for coupling a load to a track/traction cable for an overhead cable transportation installation, said clamp comprising:

a clamp body having a transverse extension coupled on one side of the body, and carrying an articulation of a suspension member for supporting the load, a cable clamping vice consisting of a fixed jaw carried by the clamp body and a movable jaw articulated on the fixed jaw, a control lever integral with the movable jaw and extends from the movable jaw for lying and moving in a plane, in order to control opening and closing of the vice, and at least one spring exerting a force on the control lever in the closed position of the jaw, wherein said spring is a flexion leaf spring in contact with the control lever and with the clamp body, said leaf spring (1) extending substantially parallel to said plane, (2) being capable of supplying a force for coupling the clamp to the cable, (3) being buttressed through an end on the clamp body or control lever, and (4) being in contact, through a middle part thereof, with the control lever or clamp body.

8. The clamp of claim 7, wherein one of the ends of the spring is rigidly anchored, while the opposite end is articulated on a rocker bar with an articulated connection.

9. A disengageable clamp for coupling a load to a track/traction cable for an overhead cable transportation installation, said clamp comprising:

a clamp body having a transverse extension coupled on one side of the body, and carrying an articulation of a suspension member for supporting the load, a cable clamping vice consisting of a fixed jaw carried by the clamp body and a movable jaw articulated on the fixed jaw, a control lever integral with the movable jaw and extends from the movable jaw for lying and moving in a plane, in order to control opening and closing of the vice, and at least one spring exerting a force on the control lever in the closed position of the jaw, wherein said spring is a flexion leaf spring in contact with the control lever and with the clamp body, said leaf spring (1) extending substantially parallel to said plane, (2) being capable of supplying a force for coupling the clamp to the cable, (3) being fixed to the clamp body and to the control lever in order to be loaded at an end thereof while being in an almost straight position on closing of the jaws and in a buckled position on opening of the jaws, and (4) carrying in a middle part thereof a control piece to come into contact with a control rail extending along a movement path of the clamp, in order to cause buckling of the spring and opening of the jaws.

10. A disengageable clamp for coupling a load to a track/traction cable for an overhead cable transportation installation, said clamp comprising:

a clamp body having a transverse extension coupled on one side of the body, and carrying an articulation of a suspension member for supporting the load, a cable clamping vice consisting of a fixed jaw carried by the clamp body and a movable jaw articulated on the fixed jaw, a control lever integral with the movable jaw and extends from the movable jaw for lying and moving in a plane, in order to control opening and closing of the vice, and at least one spring exerting a force on the control lever in the closed position of the jaw, wherein said spring is a flexion leaf spring system in contact with the control lever and with the clamp body, said leaf spring system (1) extending substantially parallel to said plane, (2) being capable of supplying a force for coupling the clamp to the cable, (3) comprising two leaf springs having opposite curvatures associated by links articulated at their ends, forming a buttressed spring in an ellipse, and (4) having a middle part of one of the leaf springs cooperating with the clamp body and a middle part of the other leaf spring cooperating with the control lever.

11. A disengageable clamp for coupling a load to a track/traction cable for an overhead cable transportation installation, said clamp comprising:

a clamp body having a transverse extension coupled on one side of the body, and carrying an articulation of a suspension member for supporting the load, a cable clamping vice consisting of a fixed jaw carried by the clamp body and a movable jaw articulated on the fixed jaw, a control lever integral with the movable jaw and extends from the movable jaw for lying and moving in a plane, in order to control opening and closing of the vice, and at least one spring exerting a force on the control lever in the closed position of the jaw, wherein said spring is a flexion leaf spring system in contact with the control lever and with the clamp body, said leaf spring system (1) extending substantially parallel to said plane, (2) being capable of supplying a force for coupling the clamp to the cable, and (3) comprising two leaf springs that are disposed symmetrically on another plane perpendicular to said plane in which the clamp body and the control lever are located, so as to ensure security of coupling of the clamp to the cable and to distribute clamping forces.

* * * * *